United States Patent [19]

Schroeder

[11] 3,960,701

[45] *June 1, 1976

[54] HYDROGENATION OF COAL TO PRODUCE COKE, PITCH AND ELECTRODE CARBON

[76] Inventor: Wilburn C. Schroeder, 7316 Radcliffe Drive, College Park, Md. 20740

[ * ] Notice: The portion of the term of this patent subsequent to Nov. 4, 1992, has been disclaimed.

[22] Filed: Dec. 2, 1974

[21] Appl. No.: 528,629

Related U.S. Application Data

[63] Continuation-in-part of Ser. No. 476,105, June 3, 1974.

[52] U.S. Cl. ..... 208/8; 208/10; 208/50

[51] Int. Cl.[2] ..... C10G 1/04

[58] Field of Search ..... 208/8, 10

[56] References Cited

UNITED STATES PATENTS

| | | | |
|---|---|---|---|
| 3,018,242 | 1/1962 | Gorin | 208/10 |
| 3,503,864 | 3/1970 | Nelson | 208/10 |
| 3,527,691 | 9/1970 | Hodgson | 208/10 |
| 3,617,513 | 11/1971 | Wilson et al. | 208/8 |
| 3,755,137 | 8/1973 | Schuman | 208/10 |
| 3,823,084 | 7/1974 | Schroeder | 208/10 |

*Primary Examiner*—Delbert E. Gantz
*Assistant Examiner*—James W. Hellwege
*Attorney, Agent, or Firm*—Bacon & Thomas

[57] ABSTRACT

Low sulfur metallurgical coke and pitch and low sulfur, ash-free carbon suitable for electrodes are produced from sulfur-containing, non-coking or coking coals by hydrogenation of such coals in an economical cyclic system in which particulate coal, in the absence of pasting oils, is contacted with a large volume of circulating hydrogen under conditions providing a low sulfur heavy oil or oil-carbonaceous solid mixture which is then converted into the coke, pitch and/or electrode carbon. Sulfur in the coal is converted to gaseous compounds and is removed from the circulating hydrogen stream. Light oils of aromatic nature are also produced.

11 Claims, 1 Drawing Figure

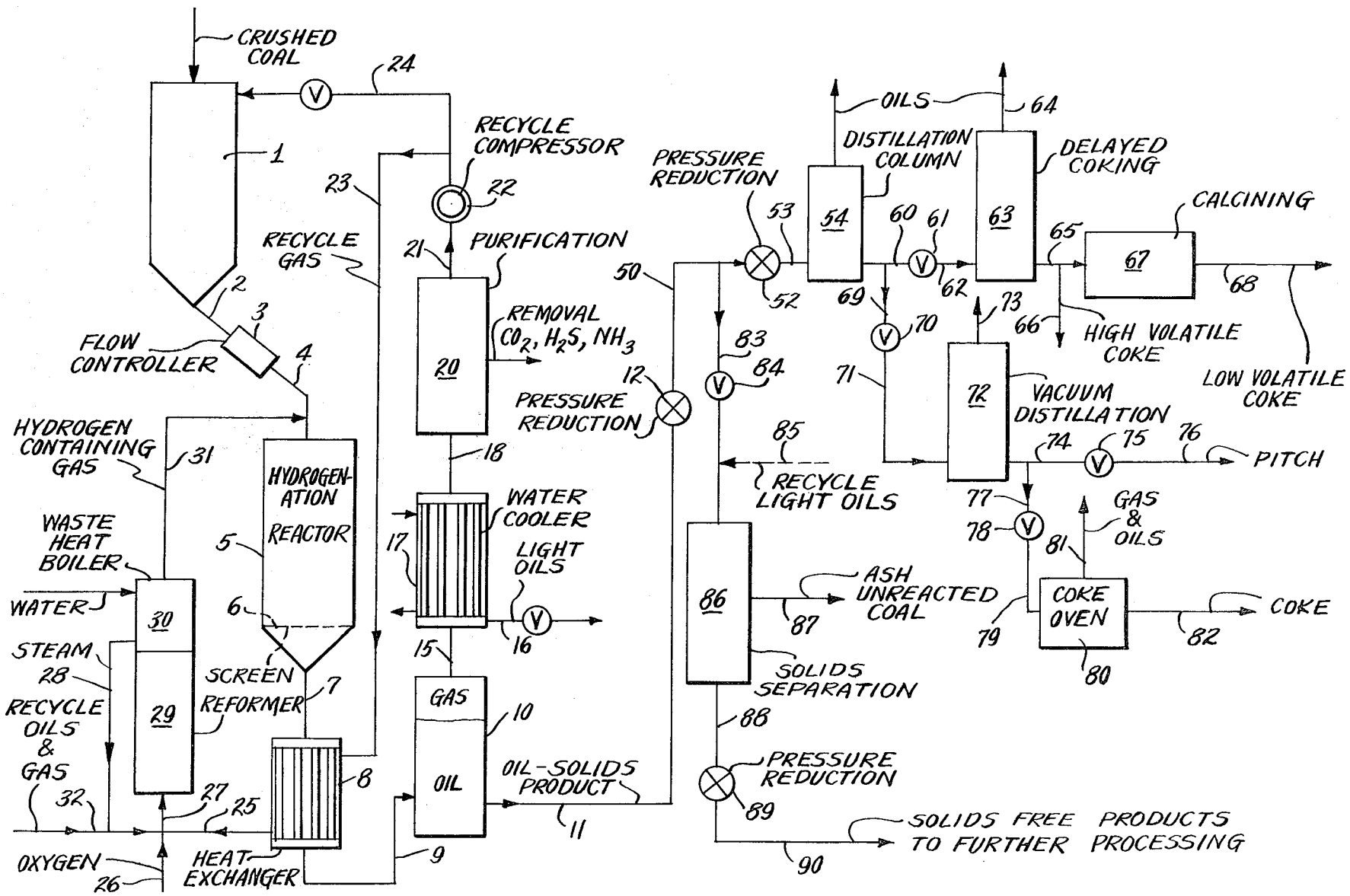
CRUSHED COAL
RECYCLE COMPRESSOR
PURIFICATION
REMOVAL $CO_2$, $H_2S$, $NH_3$
PRESSURE REDUCTION
WATER COOLER
LIGHT OILS
GAS
OIL
OIL-SOLIDS PRODUCT
RECYCLE GAS
FLOW CONTROLLER
HYDROGEN-ATION REACTOR
SCREEN
REFORMER
HEAT EXCHANGER
HYDROGEN CONTAINING GAS
WASTE HEAT BOILER
WATER
STEAM
RECYCLE OILS & GAS
OXYGEN
OILS
DISTILLATION COLUMN
DELAYED COKING
CALCINING
HIGH VOLATILE COKE
LOW VOLATILE COKE
VACUUM DISTILLATION
PITCH
GAS & OILS
COKE OVEN
COKE
PRESSURE REDUCTION
RECYCLE LIGHT OILS
ASH UNREACTED COAL
SOLIDS SEPARATION
PRESSURE REDUCTION
SOLIDS FREE PRODUCTS TO FURTHER PROCESSING

HYDROGENATION OF COAL TO PRODUCE COKE, PITCH AND ELECTRODE CARBON

COPENDING APPLICATION

This application is a continuation-in-part of my application Ser. No. 476,105 filed June 3, 1974.

BACKGROUND and PURPOSE

This invention relates to a process for converting weakly or non-coking or caking coals to metallurgical coke, pitch, electrode carbon and other useful products.

In the past several decades coking coals with low sulfur content suitable for making metallurgical coke have become increasingly difficult to find and more costly to produce in the United States and in other countries. These problems could be greatly alleviated if a practical process could be found for converting non-coking subbituminous coal and lignite to coke. Such processes would be especially applicable in geographical locations, such as the Western part of the United States, where immense reserves of low rank non-coking coals are available.

One object of this invention is to provide a process whereby weakly or non-coking or caking coals can be economically converted into coke suitable for blast furnace or other metallurgical use.

At the present time the aluminum and electrochemical industries cannot use coke or calcined carbon for electrodes which has been prepared from coal, as this is generally too high in ash to be satisfactory. Consequently they use coke obtained from petroleum such as from delayed coking or other refining processes. With the increased price of crude oil petroleum coke has also increased greatly in price, and it has become difficult to obtain coke low in impurities including sulfur.

Electrodes, such as used in the aluminum industry for example, are prepared by mixing crushed petroleum coke (of high purity and especially low in silica, iron and sulfur) with about 25 percent by weight of pitch. This mixture is pressed into the electrode shape and then calcined at high temperature to produce a dense, strong electrode with good electrical conductivity. The pitch which is the binder in the electrode has in the past been obtained from the tar produced in the operation of coke ovens. This material now commands a high price and is in short supply.

A second object of this invention is, therefore, to provide a process for converting all ranks of coal except anthracite to both pitch and electrode carbon of high purity for the aluminum, electro-chemical, and other industries.

Aromatic chemicals for the preparation of raw materials for plastics and fibers are also obtained from tar and oils from coke ovens. Growth in this section of the chemical industry has far outstripped the growth rate for coke ovens and consequently only about 10 percent of these products can now be supplied by the coking industry. The petroleum industry has been able to supply this increasing demand. However, since crude oil consists mainly of aliphatic compounds, complex hydroforming processes are necessary to produce aromatics. High prices and short supplies have resulted.

It is, therefore, a third object of this invention to provide a relatively simple and economic process which makes use of the natural ring structure of coal to provide aromatic chemicals for the plastic and related industries.

It is well known that sulfur is objectional in metallurgical coke. Sulfur limits are even lower for the coke and pitch used to make electrodes. Another object of this invention is to eliminate the sulfur from coal during the conversion process.

Other advantages of the process, including good control of product composition, simplicity and low capital cost and operating costs, will become apparent during the description thereof.

BRIEF DESCRIPTION OF THE PROCESS

Coking or non-coking coals are hydrogenated by the process set forth in this invention to produce a heavy oil or oilcarbonaceous solids mixture which is then converted to metallurgical coke, electrode carbon and/or pitch. The non-coking coals are converted to coking coals by eliminating or reducing the sulfur and oxygen in the coal structure and by adding enough hydrogen to provide sufficient bitumen or tar to provide the molten carbonaceous mass which is necessary for the coking process. The process involves two major steps: hydrogenation of the coal followed by processing the hydrogenated product. The hydrogenation step is similar to the process set forth in my patent application Ser. No. 476,105 filed June 3, 1974.

Briefly, this comprises contacting the coal in particulate form in the absence of pasting oil with hydrogen at a temperature in the range of about 820° to 1000°F and a pressure in the range of about 500 to 4000 psi in a hydrogenation zone of a closed, cyclic, high pressure system through which a relatively large volume of hydrogen is circulated and in which the hydrogen for the coal conversion is produced in a reforming zone from recirculated gaseous hydrocarbon by-products of the hydrogenation reaction. The only raw materials that are essential in this system are coal, oxygen and water (in the form of steam) all of which are introduced at system pressure. Most of the sulfur in the coal is contained in the gaseous component of the effluent from the hydrogenation zone and is removed without substantial reduction in system pressure prior to recirculating the gases through the reforming zone of the system. The contact time between the coal and hydrogen is small, in the order of 10 seconds to 5 minutes depending on the nature of the coal, the exact temperature and pressure and the degree of hydrogenation desired. Usually, conditions are selected to hydrogenate the coal only to the extent necessary to remove sulfur and provide a heavy oil or heavy oil-carbonaceous solids mixture in the effluent from the hydrogenation zone. This product is separated from the large volume of circulating gases.

The heavy oil or oil-coal dispersion from the hydrogenation process is cooled and the pressure is reduced. If it is unnecessary to have an ash-free product, the product can then be distilled to remove any light oils which are useful by-products from the process. In one embodiment of the invention, the distillation bottoms can then be further processed by vacuum distillation to produce pitch. This pitch can be used as desired or can be fed to coke ovens to make metallurgical coke.

Alternatively, a second method of producing coke from the oil solids dispersion may be used. In this method the material is fed to a delayed coker which breaks it down to oils and coke. This coke contains about 10–25 percent volatile matter and can be further calcined to make metallurgical grade coke.

If it is desired to produce high purity, ash-free electrode carbon and pitch the coal is hydrogenated as described above. In this case, however, the hydrogenation is carried far enough to produce sufficient light oil component so that the oil solids dispersion can be filtered or centrifuged to separate ash and other solids from the liquid. The filtered liquid is then processed as indicated above to produce ash-free pitch and coke.

Light and heavy aromatic oils are produced during the hydrogenation step and in the processing of the oil-solids dispersion to provide coke and pitch products. Recovered by-product oils are used as the raw materials to make aromatic liquids for the plastic industries.

DETAILED DESCRIPTION OF THE INVENTION

The invention is described in conjunction with the accompanying drawing wherein:

The sole FIGURE is a flow diagram of the process showing the steps for converting raw coal to coke, pitch, and electrode carbon.

Referring now to the drawing, coal, which is of any type other than anthracite, is crushed to approximately minus 100 mesh, dried to any desired degree and fed to pressurized feeder 1 which may be of the type described in my U.S. Pat. No. 3,762,773 (Oct. 2, 1973). A pressure equalizing line 24 maintains at least as high pressure in the feeder 1 as exists in the coal hydrogenation system. From feeder 1 the coal flows through line 2, flow controller 3, and line 4 into coal hydrogenation reactor 5. Hot hydrogen-containing gas from line 31 joins the coal in line 4.

The coal hydrogenation reactor 5 is a cylindrical high pressure vessel equipped with screen 6 near the bottom which supports a suitable hydrogenation catalyst. Coal and hydrogen enter at the top, flow downward over the catalyst, and the products, which are liquids, solids and gases, leave the bottom of the reactor through line 7.

Temperatures in the reactor 5 are in the range from about 820° to 1000°F and pressures from 500 to 4000 psi. The hydrogen-containing gas brought in through line 31 is at a sufficiently high temperature to heat the coal and to maintain the desired temperature in the coal hydrogenation reactor 5.

The most suitable conditions to be maintained in the reactor 5 will depend on the coal being processed as well as on the products being produced. In general, operating conditions other than temperature and pressure are as follows:

1. Retention time for the coal particles is between about 10 seconds to a few minutes with lower temperatures requiring longer times.

2. The amount of hydrogen required is up to about 3 or 4 weight percent of the coal fed, with coals containing high oxygen and sulfur requiring more hydrogen.

3. The amount of hydrogen circulated through the reactor will be between about 2 or 3 and 10 times the hydrogen consumed in the hydrogenation process.

4. A satisfactory catalyst is iron or steel turnings supported on screen 6. Other heavy metal catalysts which are well known and suitable for coal hydrogenation may be used. The catalysts may be supported on carriers of suitable size and shape to be retained on the screen 6 and to permit passage of the materials. It should be noted that in the method of operation depicted in the flow sheet the coal is entrained in the gas which flows downward through the reactor. Other methods of operation may be used including upward flow with the coal entrained in the gas, or upward flow with the coal present in fluidized beds. Catalyst may be used in a fixed or ebullating bed or it may be mixed with the coal or sprayed on it in the form of a solution before the coal is fed to the reactor.

Gas, oils and solids pass from reactor 5 through line 7 into a heat exchanger 8 where they are cooled by recycled hydrogen-containing gases. The heavy oils and tars are condensed and pass through line 9 to vessel 10 which is a gas-oil solids separator. Oil-tar-solids are taken out through line 11, pressure reduction device 12 and line 50. This is the primary product from the hydrogenation process.

Gas, which is at the pressure of the hydrogenation system, passes through line 15 into a water cooled heat exchanger 17. Lighter oils condense and are removed from the heat exchanger through line 16 which is equipped with a suitable valve. These oils may be used in the process as described below or may be processed as useful by-products.

Gases, which contain $H_2$, $CH_4$ and higher hydrocarbons, $CO_2$, $H_2S$ and $NH_3$, leave the heat exchanger 17 through line 18 to purification system 20. This may be a water wash or purification by monoethanolamine, hot potassium carbonate, or other well known means to remove $CO_2$, $H_2S$ and ammonia from the gas. Processes are also available to separate the $H_2S$ and $NH_3$ from the $CO_2$ and to recover S and ammonia as marketable products. Separation at 20 should be at system pressure.

The purified gas, which is essentially hydrogen and methane containing some higher hydrocarbons and which is at substantially the pressure of the hydrogenation system, passes through line 21 to recycle compressor 22 which restores the small amount of pressure lost in flow through the system.

Gas from the recycle compressor 22 flows through line 23 to heat exchanger 8. Gas in line 24, which is connected to line 23, also maintains the necessary system gas pressure in coal feeder 1.

The gas from heat exchanger 8 passes through lines 25 and 27 to a reformer 29. Oxygen under system pressure from an oxygen plant (not shown), and preferably which has been preheated, is supplied by line 26 and flows into line 27. Superheated steam at system pressure from a waste heat boiler 30, which is connected to reformer 29, passes through line 28 into line 27. Recycle gas or oil from other parts of the system may also be fed to the reformer through line 32.

Reformer 29 is preferably an internally insulated, refractory lined, water jacketed, steel vessel suitable for use at temperatures up to about 3000°F and pressures required in the cyclic system. Reactions in the reformer 29 between hydrocarbon-containing recycle gases, oxygen and steam generate largely hydrogen and carbon monoxide, along with a small amount of carbon dioxide. More particularly, the reactions are between hydrocarbon gases, oils (and carbon) with oxygen to furnish heat and between these gases and water to produce hydrogen. The reactions are well known in the art and need no explanation here.

It is desirable to run the reformer 29 at high temperatures since this increases the speed of the reactions and especially the rates of steam decomposition. It also reduces the amount of carbon dioxide in the gas. In general, the minimum desirable temperature is about 1800°F and the maximum about 3000°F. Reformer 29 may also be operated with one or more beds of catalyst to promote the reactions between hydrocarbon gases and steam. Several suitable catalyst compositions are available, usually containing a high proportion of nickel. The presence of the catalyst permits operation at lower temperature, reduces the amount of excess steam required, and promotes the reaction of steam and gases to form CO and $H_2$.

Primary control of the gasification temperature in the reformer 29 is by the amount of oxygen and steam admitted, with more oxygen increasing the temperature, and more steam decreasing the temperature. Secondary control is by the degree of preheat of these reactants. The steam is always supplied in substantial excess of the stoichiometric requirements and the oxygen in insufficient amount to cause excessive production of $CO_2$ and $H_2O$.

The hot gases from the reformer 29 pass through waste heat boiler 30 to generate steam. The steam generated in the water cooled jacket of the reformer and in the waste heat boiler may be used to supply the steam requirement of the reformer.

The hot gases leaving the waste heat boiler 30, which will generally be at a temperature of 1400°F or higher depending on the heat requirements of hydrogenator 5, leave through line 31 and mix in line 4 with coal entering from line 3. The hot gases and coal then enter hydrogenator 5.

Methane and higher hydrocarbon gases (which are at the pressure of the system) released from the coal during hydrogenation will normally furnish most of the fuel necessary for the operation of the reformer. This is particularly the case since the hydrogen requirements for the production of materials for making pitch and coke are low. However, if additional fuel is needed, it is available in the form of oil from the coking operations, or elsewhere in the system, which may be conveniently pumped to system pressure and injected into the reformer through line 32, as previously noted. Gases obtained during the processing of the products from the coal hydrogenation step to make coke and pitch may also be used in the reformer. These gases are at atmospheric pressure and it will be necessary to compress them to the pressure in the coal hydrogenation system before they can be injected into the reformer through line 32.

The primary product from the hydrogenation process goes through line 11 to pressure reduction device 12 to bring the pressure down to a few hundred psi. It may then be treated (1) to produce a coke and pitch containing ash, or (2) processed through a solids separation step and then converted to coke, pitch or electrode carbon of high purity. If desired, the hydrogenation product stream in line 11 may be split and a number of coke, pitch and/or carbon products produced.

For products in which ash is permissible the oil solids product flows from line 50 into pressure reduction device 52, where the pressure is reduced to atmospheric. In then passes through line 53 to distillation column 54 where most of the distillable oil is removed. If coke is to be produced, the bottom material from distillation column 54 passes through line 60, valve 61 and line 62 to delayed coking device 63. Here more oil is produced by the high temperature cracking and is withdrawn through line 64. The coke is removed from the delayed coker at 65 and may be withdrawn as product at 66. This coke will contain ash and the volatile matter generally will be in the range from 10 to 25 percent. If a low volatile coke is desired this may be produced by a further calcining, for example as in a rotary kiln 67 with the product coke being withdrawn at 68.

To produce pitch (containing ash), the heavy oil mass from distillation column 54 passes through line 69, valve 70, line 71 to vacuum distillation 72. Here the lighter oils are driven off through line 73 to leave pitch bottoms of the desired gravity, viscosity and pour point which is withdrawn through line 74, valve 75 and line 76.

The pitch may also be converted to coke of low volatile content by passing it through line 77, valve 78 and line 79 into coke oven 80. In the coking step the pitch is heated to produce gas and oils which are withdrawn through line 81, the coke is removed at 82 and after cooling is the final coke product.

It is necessary to remove ash and other solids from the hydrogenation product to produce high purity pitch, coke and electrode carbon. This may be done by filtration, centrifuging, settling or other suitable methods for separating ash and coal particles from oil. As aforementioned, the coal hydrogenation process in this instance may be operated to produce a final product sufficiently low in tar and high enough in fluidity to satisfy the requirements of the solids separation method. This is largely dependent on the coal used and the amount of hydrogen added. In general, hydrogen addition can be increased by increasing the ratio of hydrogen to coal, longer retention time, higher pressure, and small increases in operating temperature.

A further simple and effective way to obtain an oil of high fluidity is to recycle light oils from the distillation steps and add it to the oil obtained from the hydrogenation process. Such light oils are available from the distillation and coking steps of the process.

Solid separation steps are advantageously carried out at as high a temperature as possible since this increases the fluidity of the oil. At the same time, to prevent volatilization of the light oils, it is desirable to maintain pressure on the system during solids separation.

Referring to the flow sheet, the oil leaving pressure reduction device 12, still at a pressure of several hundred psi, flows through lines 50 and 83 and valve 84 to solids separation device 86. Light recycle oils are pumped through line 85 to line 84.

A number of filtration methods have been developed for the separation of ash and unreacted coal from coal extracts including rotary drum filters and precoated thimble type filters. Several methods have also been suggested for centrifugal separation, including a preferred method using two centrifuging steps as described in U.S. Pat. No. 3,240,566 (Bullough and Schroeder, Mar. 15, 1966).

The ash and unreacted coal are withdrawn at 87. The solids free oil product is withdrawn through line 88 and the pressure on the system is reduced to atmospheric in 89. The product then leaves through line 90 and is processed as previously described and shown with respect to ash-containing material to produce high purity pitch as well as high and low volatile high purity coke. The high purity coke is converted to electrode carbon by suitable calcining.

It will be noted that oils free from coal or ash are removed from various points in the process as follows: the water cooler 17, distillation column 54; delayed coking device 63; vacuum distillation device 72; and coke oven 80. These oils are very high in aromatic content due to the aromatic nature of the coal structure and the relatively low degree of hydrogenation carried out in the process. They are also mainly neutral oils since much of the oxygen has been removed as $H_2O$ or $CO_2$ and the nitrogen as $NH_3$. They contain single ring aromatic compounds such as benzene, toluene and xylene and also multiple ring compounds such as naphthalene and others.

These oils can be separated by fractionation, solvent extraction, crystallization, and other processes commonly applied in the tar and petroleum industries to produce marketable products and especially products useful in the plastics and related industries.

The distillation and coking operations are representative methods for producing coke and pitch from oils and tar. Such variations and modifications as will occur to those skilled in this art may be utilized without departing from the general concepts of this invention. The invention is further illustrated by the following representative examples.

EXAMPLE 1

An example of the application of the processes of this invention to a non-coking Wyoming subbituminous coal to produce solids free pitch and electrode carbon follows: Coal analysis (wt. percent):

| | |
|---|---|
| Ash (dry basis) | 5.2 |
| Volatile matter (moisture and ash free) | 46.0 |
| Ultimate (maf) | |
| H | 5.3 |
| C | 78.6 |
| N | 1.7 |
| O | 13.3 |
| S | 1.1 |
| | 100.0 |

Hydrogenation operating conditions:

| | |
|---|---|
| Pressure, psi | 2000 |
| Temperature °F | 880 |
| Retention time, sec | 10 |
| Hydrogen used (scf/ton, maf coal) | 5200 |
| Hydrogen recirculation (scf/ton) | 30000 |
| Oxygen required (scf/ton) | 2000 |

Products produced (solids free-lbs/per ton maf coal):

| | |
|---|---|
| Pitch | 440 lbs |
| Electrode Carbon | 700 lbs |
| Oils | 150 lbs |

EXAMPLE 2

It has been noted that the distribution of products as shown in the first example depends on the operation conditions used in the processing steps. This is illustrated for the same coal used in the first example by increasing the retention time and amount of hydrogen used in the hydrogenation step to produce more oil and less coke. New conditions and products are as follows:

Hydrogenation operating conditions:

| | |
|---|---|
| Pressure psi | 2000 |
| Temperature °F | 880 |
| Retention time (sec.) | 18 |
| Hydrogen used (scf/T) | 7500 |
| Hydrogen recirculation (scf/T) | 40000 |

-continued

| | |
|---|---|
| Oxygen required (scf/T) | 3000 |

Products produced (lbs per ton maf coal)

| | |
|---|---|
| Pitch | 440 |
| Electrode carbon | 500 |
| Oils | 250 |

These examples illustrate two applications of the processes disclosed in the invention. Other applications will be apparent to those skilled in the art.

I claim:

1. A method for preparation of low sulfur pitch, coke and aromatic oils from sulfur-containing coal comprising introducing said coal in the absence of a pasting oil into a hydrogenation zone of a closed cyclic system having hydrogenation, purifying and oxygen-steam reforming zones, said system being maintained at a pressure in the range of about 500 to 4000 psi, hydrogenating said coal in the hydrogenation zone at a temperature in the range of about 820° to 1000°F with hot hydrogencontaining gases from the reforming zone, said gases also containing carbon monoxide and excess steam, to provide an effluent stream containing excess hydrogen, gaseous hydrocarbons, a heavy carbonaceous liquid and solids fraction, and gaseous impurities including sulfur compounds, removing the heavy, carbonaceous liquid and solids fraction from said effluent stream without substantial reduction in system pressure, removing sulfur compounds from the resulting gaseous stream without substantial reduction in system pressure, introducing the resulting purified gaseous stream, steam and oxygen into said reforming zone to provide the hot hydrogen-containing gases for introduction into said hydrogenation zone, and removing distillable oils from said carbonaceous liquid fraction to produce pitch or coke and aromatic oils.

2. The process of claim 1 wherein a portion of the products are aromatic oils.

3. The process of claim 1 wherein oils removed from the heavy carbonaceous liquid fraction during production of pitch or coke are recycled to the reforming zone for production of hydrogen.

4. The process of claim 1 wherein the heavy carbonaceous liquid and solids fraction is filtered without complete reduction of system pressure to remove solids and the resulting ash-free fraction is converted to pitch, coke or electrode carbon.

5. The process of claim 4 wherein at least a portion of the oils produced during conversion of the heavy carbonaceous liquid to pitch, coke or electrode carbon is recycled to the heavy carbonaceous liquid and solids fraction prior to filtration to improve filterability.

6. The process of claim 4 wherein the coal is hydrogenated to the extent necessary to provide a filterable heavy carbonaceous liquid fraction.

7. The process of claim 1 wherein the amount of hydrogen used during the hydrogenation is less than about 4 weight percent of the coal fed to the hydrogenation zone and the amount of hydrogen circulated through the hydrogenation zone is about 2 to 10 times the hydrogen consumed.

8. The process of claim 1 wherein the heavy carbonaceous liquids and solids fraction is subjected to distillation, coking and calcining to produce high grade, low sulfur, metallurgical coke.

9. The process of claim 1 wherein the heavy carbonaceous liquid fraction is subjected to distillation followed by coking and wherein gases from the coking step are compressed and introduced into the reforming zone to provide hydrogen for the hydrogenation zone.

10. The process of claim 1 wherein the coal introduced into the hydrogenation zone is a sulfur-containing, sub-bituminous coal.

11. A method for producing a low-sulfur, ash-free pitch, coke or carbon product from sulfur-containing, non-coking coal comprising subjecting said coal in the absence of pasting oil to hydrogenation under pressure and temperature conditions sufficient to convert sulfur in the coal to gaseous compounds and carbon in the coal to heavy liquid form, separating the heavy liquid fraction from the sulfur-containing gases without substantial pressure reduction, filtering the heavy liquid fraction while still under pressure, and converting the filtered liquid to said pitch, coke or carbon product.

* * * * *

UNITED STATES PATENT OFFICE

CERTIFICATE OF CORRECTION

Patent No. 3,960,701 Dated June 1, 1976

Inventor(s) WILBURN C. SCHROEDER

It is certified that error appears in the above-identified patent and that said Letters Patent are hereby corrected as shown below:

Column 2, line 16, insert a hyphen between "oil" and "carbonaceous" to read --oil-carbonaceous--

Column 3, line 7, change "component" to --components--

Column 5, line 60, change "In" to --It--

Column 6, line 11, change "is" to --are-- line 35, change "it" to --them--

Column 7, line 57, change "operation" to --operating--

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*